US005436275A

United States Patent [19]

Kawasaki et al.

[11] Patent Number: 5,436,275

[45] Date of Patent: Jul. 25, 1995

[54] POROUS ACRYLONITRILE POLYMER FIBER

[75] Inventors: Shiro Kawasaki; Mamoru Ashida, both of Okayama, Japan

[73] Assignee: Japan Exlan Company Limited, Osaka, Japan

[21] Appl. No.: 345,402

[22] Filed: Nov. 21, 1994

[30] Foreign Application Priority Data

Nov. 30, 1993 [JP] Japan ..... 5-329711
Nov. 30, 1993 [JP] Japan ..... 5-329712

[51] Int. Cl.[6] ..... C08F 20/49

[52] U.S. Cl. ..... 521/142; 526/341; 526/342; 264/165; 264/206; 264/331.16

[58] Field of Search ..... 521/64, 142; 526/341, 526/342; 264/165, 206, 331.16

[56] References Cited

U.S. PATENT DOCUMENTS 4,861,659 8/1989 Takada et al. ..... 526/341 X
4,952,453 8/1990 Uchida ..... 526/341 X

FOREIGN PATENT DOCUMENTS 1009923 1/1980 Japan .

*Primary Examiner*—Fred Teskin
*Attorney, Agent, or Firm*—Armstrong, Westerman, Hattori, McLeland & Naughton

[57] ABSTRACT

This invention offers the porous fiber in which the porous form of the fiber is with an excellent durability to heat and accordingly can afford the fiber products with a shape-retaining ability.

Porous acrylonitrile fiber comprising the polymers containing not less than 95% by weight of acrylonitrile in a bonded form whereby the pores in the fiber constituting the porous structure are connected each other and are communicated with the fiber surface and, in addition, having a specific decreasing rate in the average pore diameter due to an introduction of a crosslinking structure thereinto.

It is possible to offer a porous acrylonitrile fiber which has a porous structure wherein the micropores in the fiber are connected each other and are communicated with the fiber surface and also exhibits an excellent retaining ability of the shape of the fiber.

2 Claims, No Drawings

POROUS ACRYLONITRILE POLYMER FIBER

FIELD OF THE INVENTION

The present invention relates to porous acrylonitrile polymer fibers (hereinafter, acrylonitrile will be referred to as "AN") and, more particularly, it relates to porous AN polymer fibers in which micropores of the fibers having a porous structure are mutually connected and communicated with the fiber surfaces whereby they can be used as a device for adsorption, occlusion, etc. and, in addition, are with an excellent heat resistance and with excellent retention of fibrous structure and pore shape of the fiber upon introducing a crosslinking structure thereinto.

BACKGROUND OF THE INVENTION

Various methods have been attempted for obtaining porous AN fibers already and, for example, there is a disclosure in the Examined Japanese Patent Publication No. 011,124/85 on the formation of water-absorptive porous AN fibers by adding cellulose acetate to AN spinning dope. However, the spinning dope to which cellulose acetate is added is with inferior stability of the dope and spinnability and is not fully satisfiable for industrial purposes. Further, heat resistance of the spun yarn is low due to a deterioration of cellulose acetate and it causes troubles during the manufacturing stages of the fiber. In addition, the quality of the product is not satisfactory.

In the Examined Japanese Patent Publication No. 042,005/86, there is a disclosure on a formation of water-absorptive porous AN fibers by adding a, nonvolatile solvent and the solvent is extracted after dry spinning. In the manufacturing steps of AN fibers either by a wet or by a dry spinning, the solvent for the spinning is usually recovered for reducing the manufacturing cost but such a means results in so much load on the recovering step of the solvent and is not so satisfactory for industrial purposes.

In the Laid-Open Japanese Patent Publication No. 025,416/72 and the Examined Japanese Patent Publication No. 008,285/73, there are disclosures in which a water-soluble compound is filled in a swollen gel tow during the manufacturing step, dried and after-treated followed by eluting the filled compound to regenerate the voids. In the Laid-Open Japanese Patent Publication No. 025,418/72, there is a disclosure in which the swollen gel tow is subjected to a wet heat treatment to make fine voids remained to impart a hygroscopicity to the AN fibers. In the conventional means of such a type, microvoids are made remained by selecting a mild drying condition to satisfy the physical properties and the dyeability of fibers. Therefore, it is extremely unstable to heating and there is a serious deterioration in quality such as a disappearance of the voids or a lowering in the shape-retaining ability of the fibrous products upon the treatment in boiling water, the steaming treatment, the ironing treatment, etc.

Moreover, such microvoids are not effective since each of the voids is apt to be present in an independent state and there is no passage which communicates the voids each other. In addition, in the Laid-Open Japanese Patent Publication No. 309,613/88, there is a disclosure in which the organic liquid with a boiling point which is not higher than Tg of the undried standard wet-spinning AN fiber and all of the water contained in the undried=fiber are substantially substituted and then dried at the temperature of not higher than the Tg of the fiber to give porous AN fibers. However, as mentioned already, there is much load on the recovery of the solvents and, in addition, the recovery of the organic liquid with low boiling point is conducted at the same time. Accordingly, that method is not industrially advantageous.

On the other hand, there is a method of introducing a cross-linking structure to the fiber for achieving the properties of the fibers such as a stability in a wet-heat, a crimp stability, a crease resistance, an improvement in elasticity, etc. For example, in the Laid-Open Japanese Patent Publication No. 005,649/75, there is a disclosure that a composite material made from a crosslinked acryl fiber and a polyamide fiber exhibits a rapid carbonation upon contacting with flames or substances of high temperature and the said composite material shows a heat- or flame-screening effect.

In the Laid-Open Japanese Patent Publication No. 012,153/77, there is a disclosure in which a polyacrylonitrile copolymer which is copolymerized with acrylamide is blended with an amino resin and, during or after the forming step of the fiber, crosslinking structures are introduced thereinto to improve the resistance to hot water and also to achieve an improvement in the fiber modulus of elasticity and a decrease in the permanent change rate. Thus, an introduction of the crosslinking structure has been attempted for improving the mechanical and physical properties of the fiber.

As mentioned hereinabove, improvements of the porous AN fibers have been mostly directed to the objects of clothing articles, nightwears and interiors which have water absorption and moisture absorption properties and, although the crosslinking structure is applied with an object of improving the mechanical and physical properties of the fiber, it is still true that, at present, thermally stable porous AN fibers having the improved property of retaining the shape of the fiber product and also of the fiber micropores and the economical manufacturing method are not obtained yet.

SUMMARY OF THE INVENTION

An object of the present invention is to offer a porous AN fiber which is thermally stable and exhibits an ability of retaining the shape of the fiber product and of the fiber micropores, wherein the micropores of the fiber having a porous structure are mutually connected and communicated with the fiber surfaces and the degree of reduction of the average micropore size after treating with dry heat of 180° C. for two hours is not more than 10% whereby it can be used as a device for adsorption and occlusion.

The above-mentioned object of the present invention can be achieved by the porous acrylonitrile polymer fiber which has a porous structure obtained by a wet-spinning of an acrylonitrile polymer containing, as chemically bonded, acrylonitrile of not lower than 95% by weight to obtain a stretched but undried fiber, which is then subjected to a wet-heat treatment at a temperature between 120° and 150° C. and thereafter subjected to a crosslinking treatment, the micropores in the porous structure having an average pore diameter of 100–6,000Å, said micropores being mutually connected and communicating with the fiber surface, and the degree of reduction of the average pore diameter after a dry heat treatment at 180° C. for 2 hours being not larger than 10% (Embodiment A).

The above-mentioned object of the present invention can be also achieved by the porous acrylonitrile polymer fiber which has a porous structure obtained by a wet-spinning of an acrylonitrile polymer containing, in a chemically bonded manner, acrylonitrile of from 95% by weight to less than 98% by weight to obtain a stretched but undried fiber, which is then subjected to a wet-heat treatment at a temperature between 120° and 150° C. and thereafter introducing a crosslinking structure using the functional groups other than nitrile groups, the micropores in the porous structure having an average pore diameter of 100–6,000Å, said micropores being mutually connected and communicating with the fiber surface, and the degree of reduction of the average pore diameter after a dry heat treatment at 180° C. for 2 hours being not larger than 10% (Embodiment B).

DETAILED DESCRIPTION OF THE INVENTION

In the porous AN fiber as such prepared in accordance with the present invention, there are micropores with a suitable diameter in the fiber, each micropore is connected in the fiber and communicated with the fiber surface because the skin layer is not formed and the micropores in the fiber are thermally stable and the shape of the fiber product can be retained because the crosslinking structure is introduced whereby it can be used as a device for adsorption and occlusion.

The present invention (Embodiments A, B) will be further illustrate as hereunder.

In the porous AN fiber having the above-mentioned specific structure, it is important that the AN polymer containing not less than 95% by weight of AN is bonded/contained (Embodiment A), the AN polymer containing from 95% by weight to less than 98% by weight of AN (Embodiment B) is formed into a fiber structure. When the bonded content of the. AN is less than 95% by weight, the pores are not connected each other in the fiber and in addition, a skin layer is formed on the fiber whereby the communication with the fiber surface is not resulted. Further, when the bonded/contained amount of the AN exceeds 98% by weight, a sufficient crosslinking structure is not able to be introduced and that is not preferred in terms of retention of the shape of the micropores.

Further, in Embodiment A, a crosslinking structure can be introduced using nitrile groups and/or other functional ones existing in the AN fiber and, though there is no particular limitation thereof so far as the AN polymer meeting with the requirement of the above-mentioned bonded content is used, its manufacture is conducted, for example, by copolymerization of a certain amount of AN with other unsaturated vinyl compound which is unable to be copolymerized with the AN and/or a monomer which can introduce a crosslinking structure thereinto.

When a polymer solely comprising AN or a copolymer comprising AN and unsaturated vinyl compound is used, a crosslinking structure can be introduced utilizing nitrile groups and/or other functional groups. When a copolymer comprising AN and a monomer which can introduce a crosslinking structure is used, the crosslinking structure can be introduced using a crosslinking agent.

Further, in Embodiment B, a crosslinking structure is introduced without the use of the nitrile group coexisting in the AN fiber but with the use of the functional groups other than the nitrile group and, therefore, when the above-mentioned bonded/contained amount of the AN is not satisfied, introduction of the crosslinking structure is not possible. When the functional groups other than the nitrile group are used for introducing the crosslinking structure, there is no particular limitation for them so far as the above-mentioned bonded/contained amount of the AN is satisfied but an example is a polymer in which from 95% by weight to less than 98% by weight of the AN and from 2% by weight to less than 5% by weight of unsaturated vinyl compound.

The above-mentioned AN polymer can be manufactured by wellknown polymerizing means such as suspension polymerization, emulsion polymerization, solution polymerization, etc. as well.

Examples of the unsaturated vinyl compound are acrylic acid, methacrylic acid or esters thereof such as methyl ester, ethyl ester, etc.; acrylamide, methacrylamide or N-alkyl substituted derivatives thereof; vinyl esters such as vinyl acetate and vinyl propionate; vinyl or vinylidene halides such as vinyl chloride, vinyl bromide and vinylidene chloride; dimethylaminoethyl esters of vinylsulfonic acid, acrylic acid, methacrylic acid, etc.; and the like. They may be used either solely or jointly.

Examples of the monomer which can introduce a crosslinking agent are acrylamide, methacrylamide, N-methylacrylamide, N-ethylacrylamide, allyl alcohol, methallyl alcohol, betahydroxyethyl methacrylate, 2-chloro-3-hydroxypropyl methacrylate, beta-aminoethyl methacrylate, beta-(N-methylamino)-ethyl methacrylate, itaconic acid and the like. They may be used either solely or jointly or, further, they may be used together with an unsaturated vinyl compound monomer.

The polymer prepared as such is dissolved in the conventional solvents for the fiber formation and the resulting spinning dope is subjected to a wet spinning using known spinherettes.

In order to make that the micropores are connected each other in the fiber and that they communicate with the fiber surface in such a spinning process, it is difficult to achieve that by the usual spinning conditions and can be successfully conducted by the following means.

Thus, when an aqueous solution of inorganic salts such as sodium thiocyanate is used as a solvent, the fiber which is spun out from the spinnerettes as above is coagulated in a coagulation liquid of 5°–15° C. (preferably 5°–10° C.), washed with water, stretched 7–15 times longer, subjected to a wet-heat treatment at 120°–150° C. (preferably 130°–150° C.) and dried at not lower than 80° C. When the temperature of the coagulation liquid is lower than 5° C., it is not possible to achieve the expected object of the manufacture of the porous AN fiber in which the micropores are connected each other in the fiber and are communicated with the fiber surface while, when the temperature is higher than the above-mentioned upper limit, the spinnability reduces and that is not preferred. When the degree of stretching does not satisfy the above-mentioned requirements, several unpreferred problems are resulted such as that a suitable strength is not imparted to the fiber, the filament is broken, etc. When the temperature for the wet-heat treatment is lower than the above-mentioned lower limit, it is not possible to give a thermally stable fiber and, at above the temperature of 150° C., the fibrous shape is not able to be retained whereupon the present invention cannot be achieved. When the temperature is lower than the above-mentioned one in the drying condition, the drying of the fiber is time-consuming and that is not industrially advantageous. When an organic solvent is used, it is preferred that the temperature of the coagulation liquid is kept at not lower than 40° C. or, more preferably, not lower than 50° C.

It is moreover necessary in the present invention that the average pore diameter is 100–6,000Å. When that is smaller than the lower limit, it is not possible to give an AN fiber exhibiting an excellent heat resistance and shape-retaining ability and being able to be used as a device for adsorption and occlusion. On the other hand, when the average diameter is larger than the upper limit, the filament is broken during the spinning and the property of the fiber such as the strength of the AN fiber is not achieved.

It is necessary that the micropores of the porous fiber having the above-mentioned average pore diameter are not independent but are connected each other and are communicated with the fiber surface. When such a requirement is not satisfied, only the fiber surface or only a few parts of inner areas of the fiber from the fiber surface can be utilized whereupon it is not possible to use the porous fiber as a device for adsorption, occlusion, etc.

Particularly when the conditions that an AN polymer containing not less than 95% by weight of AN (Embodiment A), from 95% by weight to less than 98% by weight of AN (Embodiment B) in a bonded form is subjected to a wet spinning and that the undried fiber after washing with water and,stretching is subjected to a wet-heat treatment at the temperature of 120°–150° C. (preferably 130°–150° C.) are adopted in:combination, the resulting porous AN fiber has a thermally stable porous structure therein where the micropores with an average pore diameter of 100–6,000Å in the fiber are connected each other and are communicated with the fiber surface and also has an excellent function of adsorption and occlusion and a suitable fiber property whereby it exhibits an excellent retaining ability for the fiber products and for the fiber pore shapes and the products are with much commercial value.

Another embodiment of the present invention will be as follows.

Thus, the following water-absorptive resin is introduced into the polymer component in the preparation of the above-mentioned porous AN fiber. Such a water-absorptive resin is a resin which has 1–15 (preferably 2–10) crosslinking bonds per 400 repetition units of the polymer, has a pore size of not larger than 0.5 micron (preferably not larger than 0.2 micron) and a water-swellability of 20–300 cc/g (preferably 30–150 cc/g) at a dried-up state and is insoluble in water and in the solvents for AN polymers. The compounding amount of such a water-absorptive resin may be selected from the range of 1–6% by weight (preferably 1–5% by weight) to the weight of the AN polymer. Introduction of such a water-absorptive resin may be carried out by adding and mixing it in an amount satisfying the above ratio to and with the polymer spinning dope. After spinning, the porous AN fiber is manufactured by conducting the above-mentioned means. There will be no particular limitation at all for the manufacturing method of such a water-absorptive resin so far as the product satisfying the above-mentioned characteristics is obtained. An example for the manufacture of the resin exhibiting such characteristics in an industrially advantageous manner is as follows.

Thus, an alkaline substance is made to act by a usual manner with an aqueous dispersion of a crosslinked AN copolymer of not less than 50% by weight (preferably not less than 70% by weight) to the total monomers constituting the polymer of AN with the pore size of not larger than 0.5 micron (preferably not larger than 0.2 micron) a certain amount of a crosslinkable monomer and other vinyl monomers which can be copolymerized with AN to introduce carboxyl groups thereinto to prepare a resin with a water swellability of 20–300 cc/g (preferably 30–150 cc/g) or an aqueous dispersion thereof in an industrially advantageous manner. when such a water-absorptive resin is prepared and used in a form of an aqueous dispersion, it is preferred to keep the form of the aqueous dispersion by shrinking the resin by, for example, means of a water-miscible organic solvent or an electrolytic salt is previously added to the medium to be treated with an alkali since said aqueous dispersion may be entirely solidified to a jelly if the aqueous dispersion is satisfied with the following formula.

$$C \times S = W$$

in which C is a concentration (% by weight) of the water-absorptive resin in the aqueous dispersion; S is a degree of water-swellability (cc/g) of the water-absorptive resin; and W is an amount of water (% by weight) in the aqueous dispersion.

Examples of the above-mentioned crosslinkable monomer are a crosslinkable monomer having two or more copolymerizable double bonds in a molecule such as di-, tri- or tetraesters of acrylic or methacrylic acid; allyl esters of unsaturated carboxylic acids; diallyl esters of polycarboxylic acids; acid anhydrides of divinyl type; and divinylsulfone, methylenebisacrylamide or divinylbenzene or alkyl- or halo-substituted derivatives thereof and/or a crosslinkable monomer having at least one epoxy group in a molecule such as glycidyl esters of the above-mentioned unsaturated carboxylic acids or unsaturated sulfonic acids and unsaturated glycidyl ethers. That which is used as a component for the copolymerization and easily gives the desired water-absorptive resin can be prepared by a crosslinking during or after the polymerization is preferred. The use of divinylsulfone, methylenebisacrylamide, divinylbenzene, etc. which have at least two copolymerizable double bonds in a molecule and are with high resistance to alkali as a crosslinkable monomer as a component for the copolymerization is particularly preferred. Incidentally, the manufacture of the water-absorptive resin which is a crosslinked AN copolymer having the above-mentioned fine pores can be advantageous carried out, for example, according to the invention of the Japanese Patent No. 1,009,923 which is owned by the same applicant.

It is preferred to use a resin in which a crosslinkable AN copolymer is copresent as the water-absorptive resin since the miscibility with the fiber-forming matrix polymer (AN polymer) or spinnability is further improved thereby.

Like the porous AN fiber containing no water-absorptive resin as mentioned already, the porous AN fiber into which the water-absorptive resin is introduced as such has the fiber pores (having a thermal stability, a shape-retaining ability of the fiber product and a porous structure) possess both micro- and micropores and are connected each other in the fiber and, moreover, are communicated with the fiber surface to exhibit excellent functions of adsorption and occlusion and suitable properties for fiber whereby the product is with much commercial value.

In treating the AN fiber having such a porous structure with crosslinking agents, known or conventional means may be used.

Examples of such a means are a method in which crosslinking agents are given to the fiber which is in an undried state after a stretching during the process and a method in which the final filament or spun yarn which is prepared by spinning, stretching, thermal treatment, crimping treatment if necessary and drying or the product thereof prepared therefrom by weaving or nonwoven fabric is heated in a solution.

When an acryl polymer prepared by a copolymerization with an unsaturated vinyl compound monomer is used, an example of utilization of nitrile group and/or other functional groups as the material to be crosslinked is that in which the acryl fiber is treated with hydroxylamine or inorganic or orgaic salt thereof or that in which it is treated with hydrazine or hydrazine hydrate. An example of a method where the groups other than nitrile group are utilized as the material to be crosslinked is the treatment with a system of sodium alcoholate and ethanol or with a system of sodium glycolate and ethanol; treating-with formalin in the presence of a basic catalyst as in the case of acrylamide copolymer; treating with a metal acetate (e.g. Cd, Zn, Pb, Co, Pb or Mg acetate) in an ethylene glycol system which is used in the manufacture of polyesters; treating with a system of sulfuric acid and formaldehyde; etc.

In the case of using a copolymer in which a monomer which can introduce a crosslinking structure is copolymerized, examples of the applicable crosslinking agent are formaldehyde, acetaldehyde, tetraoxane, trichloroaldehyde, glycerol diepoxide, dimethylolurea, trimethylolmelamine, pentaerythritol bisacetal, etc. They may be used either solely or jointly.

If necessary, an accelerator for the crosslinking reaction such as organic or inorganic acid (e.g. acetic acid, sulfuric acid and phosphoric acid) or inorganic salt (e.g. ammonium sulfate and ammonium chloride) may be further added thereto.

Concentration of the treating liquid used in the treatment by a crosslinking agent in the present invention may vary depending upon the type of the monomers copolymerized to the fiber, the amount of said monomer, treating temperature, treating time, etc. and, usually, the concentration of not less than 0.01 mole/liter is preferred. Particularly preferably, it is from 0.01 to 1.0 mole/liter. Preferred treating temperature is 20° C. or higher and, particularly preferably, 40°-100° C.

Inherently, a crosslinking reaction does not proceed under the above-mentioned treating concentration and temperature but, thanks to the characteristic feature of the present invention that the micropores in the fiber are connected each other and are communicated with the fiber surface, it is now possible to adopt such a lower concentration and temperature.

It is necessary that the pore diameter of the porous AN fiber of the present invention in which the crosslinking structure is introduced by the above-mentioned treatment is within such an extent that the degree of reduction after treated at a dry heat of 180° C. for two hours is 10% or less. If such a requirement is not satisfied, the porous structure in the fiber becomes smaller or the micropores of the porous fiber which are connected each other are clogged and become to be an independent state whereupon it is no longer possible to use as a device for adsorption, occlusion, etc.

Such a temperature condition is used for an accelerated evaluation of the shape-retaining ability of the fiber. It is supposed that, for example, when the temperature of lower than 180° C. is adopted, the degree of reduction of the average pore diameter lowers than the above while, when the temperature of higher than 180° C is adopted, said degree increases. However, when the range for the temperature and the time is out of the above-mentioned one, coloration of the fiber significantly proceeds whereupon it is difficult to judge whether the micropores are communicated with the surface. Accordingly, the above-given conditions are adopted.

The porous AN fiber in accordance with the present invention is within such a range that, during the coagulation step of forming the fiber by a wet spinning, the percentage of the AN of the AN polymer for forming or introducing the porous structure most positively or for forming the fiber is within a necessary range and further that the undried fiber is subjected to a wet-heat treatment under an essential condition to introduce a porous structure wherein said micropores are connected each other and are communicated with the fiber surface whereby it is now possible to use as a porous AN fiber having an excellent heat stability and an ability of retaining the fiber shape and the Fore state in the fiber.

EXAMPLES

For better understanding of the present invention, several examples will be given as hereinafter. However, they are given only for the purpose of exemplification and are not intended to limit the scope of the present invention thereto.

In the examples, the terms parts and % are those by weight unless otherwise described. Incidentally, the average pore diameter, transparency, the state of dye adsorption and degree of reduction of the average pore diameter in the examples were measured by the following methods.

(1) Average pore diameter (Å).

The average diameter of the micropores in the fiber was measured by using a micromeritix pore sizer type 9310 (Shimadzu).

(2) Transparency.

The fiber was dipped in a liquid prepared by adding ethyl alcohol to dimethyl phthalate followed adjusting the refractive index to 1.506 (the same refractive index as an acryl fiber) and the degree of transparency was checked. (When the internal part of the fiber is densified or when the micropores in the fiber are connected each other and are communicated with the fiber surface, the result is transparent while, when the micropores of the fiber are not connected each other but are present independently and/or when said micropores are not communicated with the fiber surface, the solution is turbid.) The result was given in "o" and "x" meaning transparent and turbid, respectively.

(3) State of adsorption of the dye.

A 1,000 ppm solution of Crystal Violet Blue (manufactured by Maeda Kasei K. K.) was prepared, the fiber was dipped in the solution at the room temperature (20° C.) for 30 minutes and the state of adsorption of the dye with the fiber was checked under a microscope. (When the micropores of the fiber are not connected each other but are present independently and/or when said micropores are not communicated with the fiber surface, the dye does not permeate into the fiber.) The result was given in o et and "x" when the dye was and was not permeated, respectively.

(4) Degree of reduction of the average pore diameter (%).

Average pore diameters of the sample before the thermal treatment and that after the "dry heat treatment at 180° C. for two hours were measured by the method given in the above (1) and the degree of reduction was calculated by the following formula.

$$D=[(D_1-D_2)/D_1]\times 100$$

in which D is a degree of reduction (%) in the average pore diameter; $D_1$ is an average pore diameter prior to the heat treatment; and $D_2$ is that after the heat treatment.

Example 1.

AN Polymers of No. 1 to No. 7 were prepared from AN, methyl acrylate (MA) and sodium metallylsulfonate (MAS) of various compositions as shown in Table 1. Each of the polymers was dissolved in an aqueous solution of sodium thiocyanate to prepare a spinning dope. Those spinning dopes were spun to prepare seven AN fibers. Coagulation was conducted in a 12% aqueous solution of sodium thiocyanate. The fiber was washed with water an subjected to a 10 times stretching. The resulting undried fiber was subjected to a wet heat treatment using steam under the condition of 130° C. for ten minutes and then dried at 100° C. for 20 minutes to give seven kinds of AN fibers.

Properties of those AN fibers are given in Table 1.

TABLE 1

| No. | Composition of AN/MA/MAS | Average Pore Size (Å) | Transparency | Dye Adsorption | Fiber Strength (g/d) |
|---|---|---|---|---|---|
| 1 | 88/12/0 | — | x | x | 2.75 |
| 2 | 93/7/0 | 150 | x | x | 2.71 |
| 3 | 94/5.7/0.3 | 280 | x | x | 2.68 |
| 4 | 95/4.7/0.3 | 440 | o | o | 2.66 |
| 5 | 96/4(VAc)/0 | 520 | o | o | 2.61 |
| 6 | 98/1.7/0.3 | 600 | o | o | 2.58 |
| 7 | 100/0/0 | 650 | o | o | 2.57 |

— Measurement impossible; VAc: Vinyl acetate

Then Nos. 4, 5, 6 and 7 which showed good result in terms of the transparency and the dye adsorption were subjected to the following crosslinking treatment. Thus, 10 grams of the fiber were dipped in a 3% aqueous solution of hydrazine, treated at 100° C. for 1.5 hours, washed with water and dried at 80° C. to prepare a porous fiber.

The resulting fiber was checked by dimethylformamide of 60° C. whether it was insoluble therein, i.e. whether it was well crosslinked. Said fiber was subjected to a dry-heat treatment and the average pore diameters were measured. The result is given as Nos. 8–11. in Table 2. At the same time, the No. 3 which was prepared hereinabove was subjected to the same treatment to give No. 12; and the No. 5 prior to the crosslinking treatment was directly subjected to a dry-heat treatment without the crosslinking to give No. 13. The result with them are given in Table 2 as well.

TABLE 2

| No. | Composition of AN/MA/MAS | Average Pore Size (Å) | Deg. of Reduction (%) | Transparency | Dye Adsorption |
|---|---|---|---|---|---|
| | | (The Present Invention) | | | |
| 8 | 95/4.7/0.3 | 415 | 5.9 | o | o |
| 9 | 96/4(VAc)/0 | 490 | 5.8 | o | o |
| 10 | 98/1.7/0.3 | 570 | 5.0 | o | o |
| 11 | 100/0/0 | 645 | 0.8 | o | o |
| | | (Comparative Examples) | | | |
| 12 | 94/5.7/0.3 | 160 | 63.6 | x | x |
| 13 | 96/4(VAc)/0 | 240 | 53.8 | x | x |

From the above Table 2, it is clearly noted that the products Nos. 8–11 which were the samples from Nos. 4, 5, 6 and 7 of the present invention retained their good transparency and dye adsorption and also retained the fine sizes of their micropores.

On the other hand, the samples No. 12 (which was prepared from No. 3 where the content of the AN was outside the coverage of the present invention) and No. 13 (which was prepared from No. 5 and no crosslinking structure was introduced) were unable to retain the shape of the micropores by the dry-heat treatment.

Example 2.

The undried fiber prepared under the same conditions as in No. 5 of Example 1 was subjected to the wet-heat treatment at the temperatures given in Table 3 for ten minutes followed by drying at 100° C. for 20 minutes to prepare the AN fibers of Nos. 14–18.

Properties of each of the AN fibers are given in Table 3.

TABLE 3

| No. | Temp. for Wet-Heat Treatment (°C.) | Av. Pore Diameter (Å) | Transparency | Dye Adsorption |
|---|---|---|---|---|
| 14 | 110 | 230 | x | x |
| 15 | 120 | 510 | o | o |
| 16 | 140 | 530 | o | o |
| 17 | 150 | 530 | o | o |
| 18 | 160 | * | * | * |

*Measurement impossible since the shape of the fiber was not retained.

It is understood from Table 3 that good transparency and dye adsorption were resulted within a range of the wet-heat treatment in accordance with the present invention.

When the temperature for the wet-heat treatment is low, satisfactory pore shape is not resulted and, in addition, the pores are clogged upon drying of the fiber whereupon the connected micropores are not obtained. Further, when the temperature is higher than the range of the present invention, it is not possible for the AN fiber to retain its shape. Then the fibers of Nos. 4, 5, 6 and 7 showing a good result in the transparency and the dye adsorption were subjected to a crosslinking treatment as given below. Thus, a solution of 0.1 mole of zinc acetate dissolved in one liter of ethylene glycol was prepared, 10 grams of each of the above fibers were treated with the solution at 80° C. for 120° minutes, washed with water and dried at 80° C. to prepare the porous fiber. Nos. 19, 20 and 21 among the fibers prepared as such were confirmed to be insoluble in dimethylformamide of 60° C. meaning that they were duly crosslinked while No. 22 was confirmed to be soluble therein, i.e. uncrosslinked. After the fibers of Nos.

19–22 were subjected to a dry-heat treatment at 180° C. for two hours, their average pore diameters were measured. The result is given in Table 4.

TABLE 4

| No. | Compn. of Polymer AN/MA/MAS | Av. Pore Diameter (Å) | Deg. of Reduction (%) | Transparency | Dye Adsorption |
|---|---|---|---|---|---|
| 19 | 95/4.7/0.3 | 415 | 5.7 | o | o |
| 20 | 96/4/0 | 485 | 6.7 | o | o |
| 21 | 98/1.7/0.3 | 550 | 8.3 | o | o |
| 22 | 100/0/0 | 300 | 53.8 | x | x |

It is clearly understood from Table 4 that the fibers Nos. 19, 20 and 21 prepared from Nos. 4, 5 and 6 which are in accordance with the present invention retain good transparency and dye adsorption and also retain micropores while, in No. 22 which is prepared from No. 7 containing 100% of AN, crosslinked structure is not introduced and the average pore diameter is significantly reduced and both transparency and dye adsorption are no good.

Example 3

Metal sodium (0.5 mole) was dissolved in one liter of dehydrated ethyl alcohol to prepare sodium alcoholate. Each 10 grams of the fibers Nos. 4, 5, 6 and 7 prepared in Example 1 were treated in 100 ml of sodium alcoholate at 80° C. for 120 minutes, washed with water and dried at 80° C. to prepare the porous fiber. The fibers Nos. 23, 24 and 25 prepared as such were insoluble in dimethylformamide of 60° C. and were confirmed to be crosslinked while No. 26 was soluble therein and confirmed to be uncrosslinked. The fibers Nos. 23–26 were subjected to a dry-heat treatment at 180° C. for two hours and their average pore diameters were measured. The result is given in Table 5.

TABLE 5

| No. | Compn. of Polymers AN/MS/MAS | Av. Pore Diameter (Å) | Deg. of Reduction (%) | Transparency | Dye Adsorption |
|---|---|---|---|---|---|
| 23 | 95/4.7/0.3 | 425 | 3.4 | o | o |
| 24 | 96/4/0 | 490 | 5.8 | o | o |
| 25 | 98/1.7/0.3 | 555 | 7.5 | o | o |
| 26 | 100/0/0 | 315 | 51.5 | x | x |

It is clearly understood from Table 5 that Nos. 23, 24 and prepared from Nos. 4, 5 and 6 which are in accordance with the present invention retain good transparency and dye adsorption and also retain their micropores while, with respect to No. 26 prepared from NO. 7 containing 100% of AN, no crosslinking structure is introduced, the degree of reduction of average pore diameter is significantly reduced and both transparency and dye adsorption are no good.

Due to the specific porous structure unlike that in the conventional water-absorptive fibers, the porous AN fiber prepared in accordance with the present invention can be utilized in many uses. In addition, the micropores forming the porous structure are connected each other and are communicated with the fiber surface and, moreover, they are resistant to heat and, therefore, they can retain the shape of the fiber and also the shape of the fiber pores whereby they can carry or can be impregnated with various agents such as insecticides, antibacterials, soil improving agents, etc. Further, they can be used as devices such as adsorbents, catalyst carriers, etc. Thus, they are able to be used in the fields of the various carrier materials and that is a significant merit of the present invention.

What we claim is:

1. Porous acrylonitrile polymer fiber which has a porous structure obtained by a wet-spinning of an acrylonitrile polymer containing, in a chemically bonded manner, acrylonitrile of not lower than 95% by weight to obtain a stretched but undried fiber, which is then subjected to a wet-heat treatment at a temperature between 120° and 150° C. and thereafter subjected to a crosslinking treatment, the micropores in the porous structure having an average pore diameter of 100–6,000Å, said micropores being mutually connected and communicating with the fiber surface, and the degree of reduction of the average pore diameter after a dry heat treatment at 180° C. for 2 hours being not larger than 10%.

2. Porous acrylonitrile polymer fiber which has a porous structure obtained by a wet-spinning of an acrylonitrile polymer containing, in a chemically bonded manner, acrylonitrile of from 95% by weight to less than 98% by weight to obtain a stretched but undried fiber, which is then subjected to a wet-heat treatment at a temperature between 120° and 150° C. and thereafter introducing a crosslinking structure using functional groups other than nitrile groups, the micropores in the porous structure having an average pore diameter of 100–6,000Å, said micropores being mutually connected and communicating with the fiber surface, and the degree of reduction of the average pore diameter after a dry heat treatment at 180° C. for 2 hours being not larger than 10%.

* * * * *